United States Patent [19]

Hiorth

[11] 4,357,882

[45] Nov. 9, 1982

[54] BUILDING FOR DETONATING EXPLOSIVES

[75] Inventor: Hans Hiorth, Lierbyen, Norway

[73] Assignee: Dyno Industrier A/S, Oslo, Norway

[21] Appl. No.: 195,212

[22] Filed: Oct. 7, 1980

[30] Foreign Application Priority Data

Oct. 26, 1979 [NO] Norway ..... 793457

[51] Int. Cl.[3] ..... E05G 1/02; E02D 27/00

[52] U.S. Cl. ..... 109/1 S; 52/169.6

[58] Field of Search ..... 109/1 S, 1 R, 1 V, 49.5, 109/80; 52/169.6

[56] References Cited

U.S. PATENT DOCUMENTS

| | | | |
|---|---|---|---|
| 2,871,802 | 2/1959 | Fishler | 109/1 S |
| 3,062,158 | 11/1962 | Davis | 109/1 S |
| 3,552,330 | 1/1971 | Youmans | 109/1 R |
| 4,151,689 | 5/1979 | Schabert | 52/169.6 |
| 4,248,342 | 2/1981 | King | 109/49.5 |

FOREIGN PATENT DOCUMENTS

| | | | |
|---|---|---|---|
| 719792 | 10/1965 | Canada | 109/1 S |
| 566129 | 12/1932 | Fed. Rep. of Germany | 109/1 S |

*Primary Examiner*—Reinaldo P. Machado
*Attorney, Agent, or Firm*—Ladas & Parry

[57] ABSTRACT

A building structure for recurrent detonation of explosive charges of up to several hundreds of kilos with the aim to obtain effective sound dampening and economical use of materials.

The building comprises a tube shaped steel structure (2) with two gable walls (4,4) inside the tube and which defines an explosion chamber (6) in the center portion thereof. One or preferably both of said two gable walls are apertured by a plurality of through-going openings. A webbed wall or the like (20) is situated at least in one end portion of the tube which together with respective adjacent gable wall (4) defines one, respectively two, gable chambers (16) which are filled with a mass of stones (18) or the like. The tube shaped steel structure is positioned horizontally and freely resting on a sand bed (36) or the like and is covered along its entire length with sand (38). The building is effective to obtain a sound dampened gas discharge and a pressure relief.

10 Claims, 3 Drawing Figures

BUILDING FOR DETONATING EXPLOSIVES

The present invention relates to a new embodiment of a building structure adapted to be used in connection with the detonation of explosives and explosive charges. The building is intended to be used for detonation of charges weighing up to a couple of hundred kilos without causing damage to the building and at the same time ensuring that the sound level outside the building is acceptable.

BACKGROUND OF THE INVENTION

The need for a building of this kind exists because of the fact that makers of explosives must constantly test the properties of the explosive products as regards such qualities as e.g. detonation velocity, the generation of energy, fragmentation quality, sensitivity, etc. Such test detonations may comprise quantities of from some very few grammes up to 25 kilos or more. One has further developed metal working techniques based upon the use of detonation energy from high explosives. In this connection, mention shall be made of metal forming and welding of joints between different metal plate elements using the so-called "metal-cladding"-method. In these processes high explosive charges are utilized, having a weight in the range of from 50 to 250 kilos. It will be known that even when detonating small charges, the sound intensity will fall in the range of 140 dB which is assumed to be directly injurious to the human ear.

PRIOR ART

In accordance with today's practice, small as well as large explosive charges are detonated in the open air, and are thus causing great inconvenience to people living in the neighbourhood.

In connection with small charges of below 2 kilos, true enough, concrete buildings have been made for repeated explosions, and one such concrete building structure is made to sustain charges of up to 25 kilos. An inherent problem with such buildings is that reinforced concrete is in itself poorly adapted to sustain rapidly changing tensile stresses.

Even with very strong reinforcements, such buildings must be designed for a very low so-called charging density, i.e.: the quantity of explosives measured in kilos divided upon the effective space volume in the volume measured in $m^3$.

For buildings made from high tension steel one may, however, theoretically increase the charging density by approximately one proportion or measure relative to the calculation basis in connection with the concrete building designed for a similar utilization range.

Norwegian Patent Specification No. 127 021 (corresponds to U.S. Pat. No. 3,832,958) discloses a building based upon an upright cylindrical steel shell to be used as a production building for industrial use. The building as disclosed will reduce the damage caused by an incidental one-time-detonation. The steel structure is designed for sustaining up to several hundreds or kilos of explosives so that the tensile stresses of the steel approach the ultimate strength, and the idea is that the roofing will blow up and immediately release the explosion pressure wave. For a building designed to be used repeatedly, simultaneously with a sound dampening effect being important, such building type will obviously present several substantial shortcomings.

OBJECT OF THE INVENTION

The main object of the present invention is to provide an improved building structure adapted to the detonation of explosive and explosive charges for testing purposes. The building must be able to sustain a very great number of such detonations without being damaged or changed in any way. By the expression "improved building" as herein used is meant a safer building, a building less liable to be damaged in any way, and a building possessing improved sound dampening qualities. A further object of the invention is to provide a building having the aforementioned qualities but which is yet reasonable to make.

THE INVENTION

The building structure in accordance with the invention is substantially characterized in that the building comprises, a tube shaped steel structure with two gable walls inside the tube and which define an explosion chamber in the centre portion thereof, one or both of said two gable walls being apertured by a plurality of through-going openings, and a webbed wall or the like at least in one end portion of the tube which together with respective adjacent gable wall defines at least one gable chamber, preferably filled with a mass of stones, said structure being effective to obtain a sound dampened gas discharge and a pressure relief, said tube shaped steel structure being positioned horizontally and freely resting on a sand bed and being covered along the entire length of the tube construction with sand.

In a preferred embodiment, both gable walls are apertured with a plurality of through-going openings and in each end portion of the steel tube there is mounted a webbed wall and a special stone filling.

In this constructional design one has calculated therewith that the steel structure alone dampens the greater part of the explosion, i.e. the sound and pressure energy created by the detonation, but a substantial part of the dampening will also be rendered by the sand cover and the stone filters in the gable rooms.

In order to keep the total construction costs at a reasonable level, it is possible to reach the high charging density by utilizing the tensile strength in high grade steel, i.e. that the space volume of the detonation room may be kept comparatively low, thereby also reducing the total dimensions of the building structure.

Furthermore, the detonation chamber or room is configurated as a hollow cylinder, a fact which renders productional advantages by utilizing steel plate rolling and welding. As gable wall structures is selected an as to strength carefully designed double-wall web construction composed of wide flanged steel sections, positioned side by side and welded together. The construction is so devised that two wall plates are interconnected with webs, so that longitudinal hollow spaces or cavities are formed between the webs. It is very important to obtain as quick a relief as possible of the pressure, which is created momentarily at the detonation in the detonation chamber.

An important feature of the construction is that pressure and gas are released out through a small cross-sectional area—e.g. apertures in the said wide flanged construction in the first of said wall plates and that the gas thereafter may undergo expansion in the cavities therebetween, after which it flows at low velocity out through larger openings or apertures in the wide flanged section forming part of the second wall surface, e.g. in the form of slits, and is distributed substantially evenly over the cross-sectional area of the said so-called sound dampening space. This may as a good and reasonable solution be filled with round stones.

The stone masses are being kept in position in these spaces by the provision in the outer part of the tube structure of a gable structure in each end constructed as a web construction being sufficiently strong to absorb the latent dynamic energy in the stone masses created by the detonation and the subsequent discharge of gases.

The ability of the building to reduce the sound intensity from detonations arising from such large quantities of explosives as are stipulated here, depends in accordance with numerous trials, upon the combined dampening effect from the steel structure, from the stone chamber and, not least, from the sand masses covering the steel structure along its entire length.

One should observe that the above described principles must be adapted to local conditions both as regards the selection of building dimensions, steel quality, the size of the stone filters, and the size of the sand covering.

For the practical utilization of a building structure in accordance with the invention one must arrange an access for the entry of explosives and other necessary materials and equipment. An access opening as small as possible through one of the gable wall sections is preferred. The door proper to the detonation chamber is made to move or pivot inwards and strong enough to sustain the detonation pressures which for this type of steel buildings should preferably be in the range of from 10 to 15 Bar. The door should also be made with an aim to provide sound dampening.

In order to facilitate the understanding of the constructional principles of the invention, the invention will be described with reference to the enclosed drawings illustrating a preferred embodiment of a building in accordance with the invention and designed particularly for making metal cladding products, and where:

Figure 1:
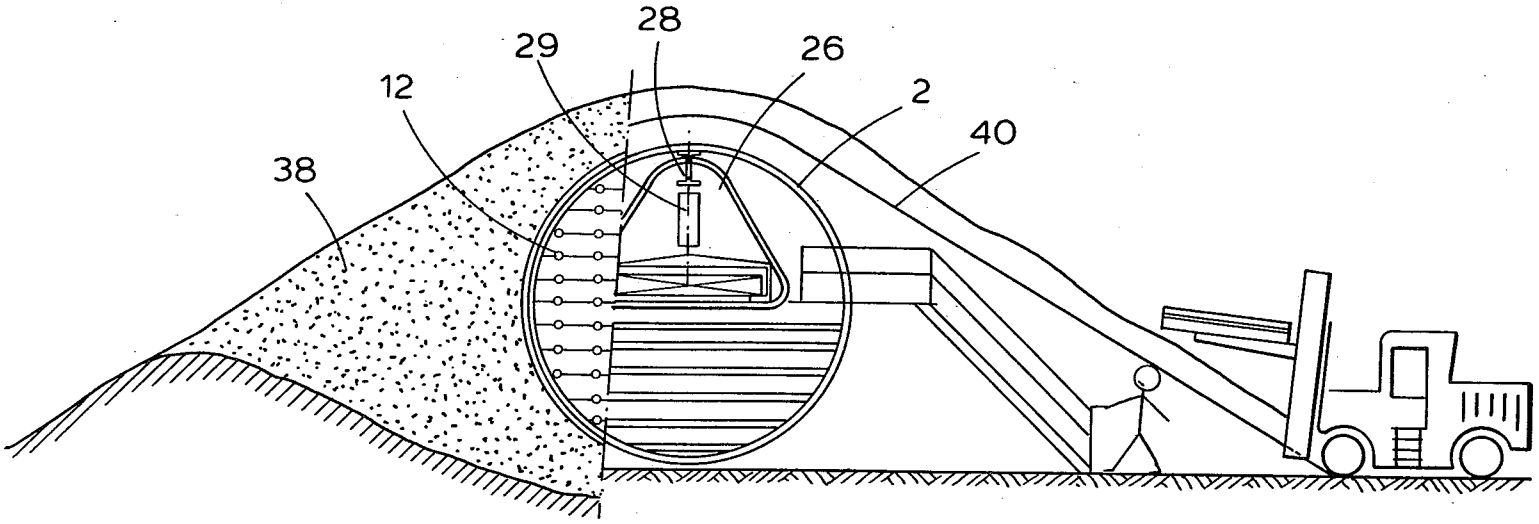
FIG. 1 is showing a building in accordance with the invention viewed partly in an elevation A—A seen from the door side, and viewed partly in cross-sectional view along the plane B—B to the detonation chamber.
Figure 2:
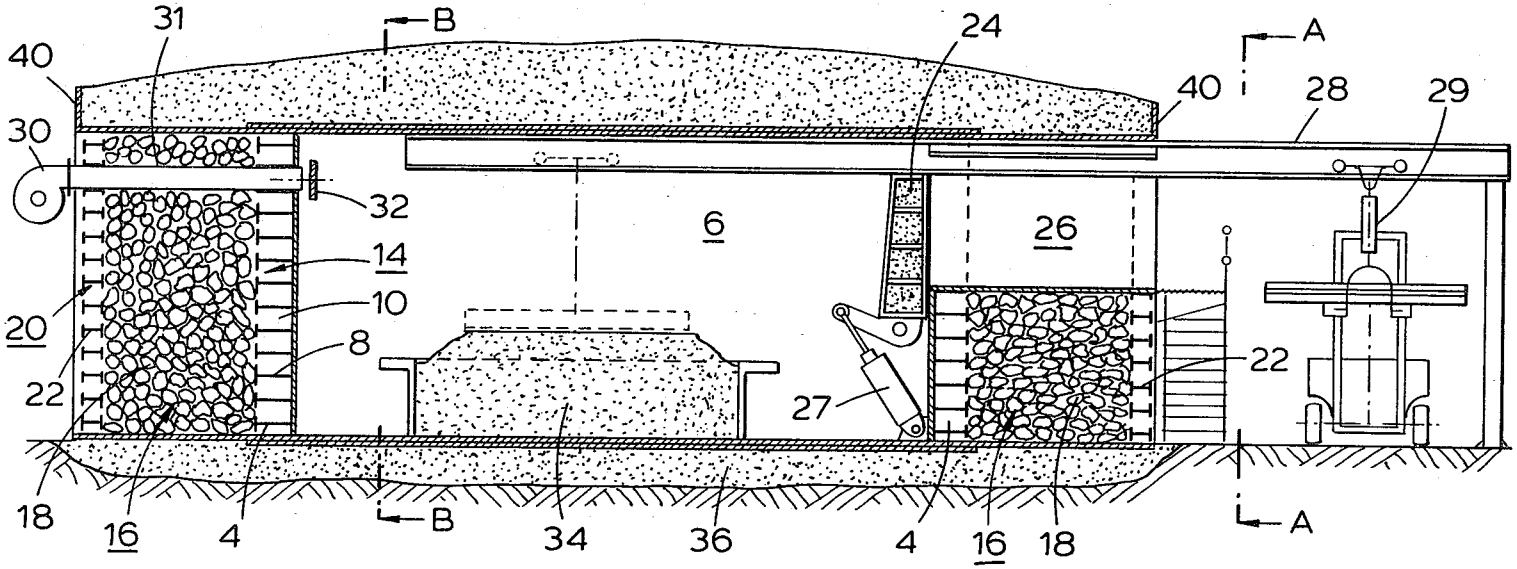
FIG. 2 shows a longitudinal section through the building shown in FIG. 1.

In the drawings, the reference number 2 designates a cylindrical steel tubing 3 which by means of two internal gable walls 4,4 is providing a room or chamber 6 in the centre portion of the tube, named the "detonation chamber", wherein the detonation corresponding to a certain quantity of TNT explosive units, is to be detonated or fired.

The length of the detonation chamber is preferably made somewhat larger than its diameter. The explosive quantity in kilos divided by the volume in cubic meter, the so-called charging density, should for this type of building preferably fall in the range of from 0.4 to 1. This corresponds to a pressure ratio in the range of from 12 to 24 Bar when neglecting the very brief "peak pressure" interval which can reach a multiple of the aforementioned pressure ratios.

Figure 3:
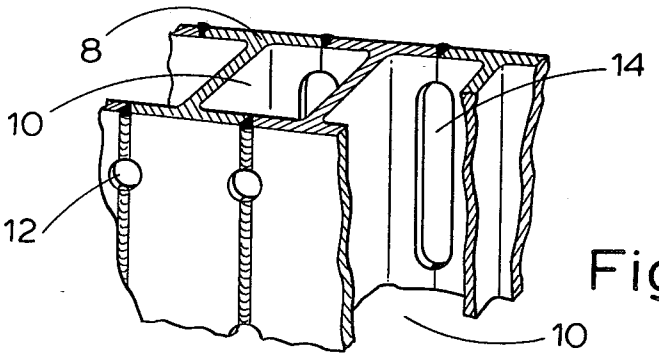
FIG. 3 is a fragmentary perspective view of the gable wall structure.

As best appears from the detailed perspective view shown in FIG. 3, the gable walls 4 are here made as a welded construction of wide flanged sectional steel elements 8 which form small hollow spaces or cavities 10. In the wall surface facing the detonation chambers are provided apertures 12 the areas of which correspond to abt. 0.5% of the total surface area of the gable wall surface. In the wall surface facing the gable rooms or stone chambers are provided large slits 14 which as to cross-sectional area preferably should constitute about 20% of the total surface area of the gable wall.

At each tube end are as shown provided special sound filter chambers 16 which in part shall dampen the detonation pressure wave and in part shall dampen the sound effect from the rapidly discharging gas flow through the apertures 12 and 14, cf. FIG. 3.

The sound filter chambers should preferably be filled with a heavy material which effectively dampens the explosion. To meet this requirement there is preferred a loading of more or less round stones 18 which are confined in the said chamber by means of an outer gable wall 20 which is made as a grated wall, preferably made from I-shaped steel sections 22.

The access door 24 is made inwardly pivotable and must as the steel construction otherwise be stipulated to sustain the pressures which may be created. The door is biased against the frame or sash around the access or supply tunnel 26. In order to open and close the access door a pressure fluid cylinder 27 is used.

For buildings adapted to large explosive quantities and heavy metal such as must be supplied for metal working purposes, one must install a special crane 29 with trolley 28 suitably arranged in connection with the access door and tunnel as shown.

In order to secure effective ventilation, which is very important for this type of building, a ventilation fan 30 is installed, including a through-going fan duct 31 at the inside end of which there is mounted a shock valve 32.

In connection with special detonation operations, such as metal cladding, a sand bed 34 is required in the building as a base for the objects to be joined by explosion welding.

The steel tube building structure as described shall in accordance with the invention be positioned horizontally and shall rest freely on a sand bed 36 preferably so that the lower edge of the steel cylinder is positioned somewhat above the surrounding ground level. By the placing of a sand mass 38 on top of the steel structure, the thickness of which on top of the cylinder may be 1 meter and having a natural fall angle of 30° on both sides, one obtains in result of detonations a substantial dampening of the created sound energy, the earth shock and the vibrations in the steel shell. By means of laterally extended end gables 40 one can provide full sand coverage along the entire length of the building.

A building in accordance with the invention is otherwise dimensioned in dependence upon the maximum explosive quantity which is to be used in the building. It may be mentioned that a building estimated for maximum 25 kilos TNT-equivalent will have a steel diameter of approx. 3.5 meters and with a steel plate thickness of high grade steel of abt. 20 mm in the detonation chamber, a total length of abt. 13 meters and a gable space length of abt. 3 meters.

It will be understood that the scope of the invention is not limited to the embodiment shown and described. Thus a building in accordance with the invention can be realized with only one end of the tube provided with gas and pressure relief. In such an embodiment one may leave out the apertures and openings in the gable walls in the closed-off end of the building.

I claim:

1. A building structure for recurrent detonation of explosive charges of up to several hundreds of kilos with the aim to obtain effective sound dampening and economical use of materials, characterized therein that the building comprises, a tube shaped steel structure (2) with two gable walls (4,4) inside the tube and which defines an explosion chamber (6) in the centre portion thereof, one or both of said two gable walls being apertured by a plurality of through-going openings, and a webbed wall or the like (20) at least in one end portion of the tube which together with respective adjacent gable wall (4) defines at least one gable chamber (16), preferably being filled with a mass of stones (18), said structure being effective to obtain a sound dampened gas discharge and a pressure relief, said tube shaped steel structure being positioned horizontally and freely resting on a sand bed (36) and being covered along the entire length of the tube construction with sand (38).

2. Building structure as claimed in claim 1, characterized in that both gable walls (4,4) are apertured with a plurality of through-going openings and that in each end portion of the steel tube there is mounted a webbed wall (20, 20) and a special stone filling.

3. A building as claimed in claim 2, characterized therein that the internal gable walls (4) are preferably made by the welding together of wide flanged steel beams (H-beams) (8) positioned side by side and being anchored to the inside of the tube structure, preferably by welding.

4. A building as claimed in claim 3, characterized therein that the flanged parts of the steel sections facing the detonation chamber are provided with through-going apertures in order to obtain a strongly choked discharge of explosion gases and in that the gable wall surfaces facing the gable chamber (16) is provided with holes or openings such as slits the total areas of which substantially correspond to the total free area existing between the stones in the stone mass positioned in the gable chamber.

5. A building as claimed in claim 4, characterized therein that the steel tube (3) for the detonation chamber (6) is cylindrical and is designed, as to strength, on the basis of the need to be able to sustain the tensile stresses arising from the prevailing gas pressure as well as the supplemental stresses and strains arising from possible hits of detonation fragments.

6. A building as claimed in claim 2, characterized therein that an access tunnel (26) is provided through one of the gable rooms and that it has an inwardly movable pressure proof steel door (24) facing the detonation chamber, the door being made as a hollow door plate being filled with a sound absorbent mass, preferably sand.

7. A building as claimed in claim 6, characterized therein that there is arranged, preferably in the gable wall not provided with an access door, a ventilation duct including a shock valve (32) and a fan (30) which is positioned at the outer gable wall.

8. A building as claimed in any of the preceding claims, characterized therein that the tube structure externally at each end is provided with a lateral buffer plate structure (40) the size of which generally corresponds to the natural fall angle of the sand covering thus enabling full sand covering along the entire length of the steel structure.

9. A building as claimed in any of the preceding claims and which is specially designed to be used for metal working purposes using heavy plating and large quantities of explosives, characterized therein that a trolley crane unit (28, 29) is installed for the transport of materials into and out of the building.

10. A building as claimed in claim 9 characterized therein that detonation of the explosive charge takes place downwardly against the plate object which is to be worked, which object is positioned on a sand bed (34) or the like specially adapted for such work operations.

* * * * *